United States Patent [19]

Zeilinger

[11] Patent Number: 4,706,427

[45] Date of Patent: Nov. 17, 1987

[54] SEALING SYSTEM

[75] Inventor: Alan Zeilinger, Cleveland, Ohio

[73] Assignee: Magic American Chemical Corporation, Cleveland, Ohio

[21] Appl. No.: 907,030

[22] Filed: Sep. 15, 1986

[51] Int. Cl.[4] ..... E04H 1/00

[52] U.S. Cl. ..... 52/288; 52/35; 52/717.1

[58] Field of Search ..... 52/278, 287, 288, 35, 52/716.1, 717.1, 718.1, 242, 290, 255, 286

[56] References Cited

U.S. PATENT DOCUMENTS

| | | | |
|---|---|---|---|
| 1,250,594 | 12/1917 | Knapp | 52/287 |
| 2,090,588 | 8/1937 | Witsell | 52/35 |
| 2,227,581 | 1/1941 | Henderson | 52/287 X |
| 2,274,317 | 2/1942 | Bonnell | 52/287 |
| 2,300,084 | 10/1942 | Wright . | |
| 2,303,864 | 12/1942 | Reasor | 52/287 X |
| 2,541,768 | 2/1951 | Keller . | |
| 2,915,794 | 12/1959 | Hillmann | 52/288 |
| 3,408,250 | 10/1968 | Finefrock . | |
| 3,464,177 | 9/1969 | Amato | 52/287 |
| 4,555,885 | 12/1985 | Raymond et al. . | |
| 4,569,171 | 2/1986 | Kuhr et al. . | |
| 4,617,209 | 10/1986 | Ives . | |
| 4,642,957 | 2/1987 | Edwards | 52/288 X |

FOREIGN PATENT DOCUMENTS

| | | | |
|---|---|---|---|
| 2060243 | 6/1972 | Fed. Rep. of Germany | 52/288 |
| 1421484 | 1/1976 | United Kingdom | 52/287 |

*Primary Examiner*—William F. Pate, III

*Assistant Examiner*—Richard E. Chilcot, Jr

*Attorney, Agent, or Firm*—Renner, Otto, Boisselle & Lyon

[57] ABSTRACT

A sealing system for sealing the junction between a horizontal surface such as the top surface of a bathtub, counter top or sink and two adjacent walls is disclosed. The sealing system seals the junction of the walls and a horizontal surface which are substantially mutually perpendicular and define two longitudinal joints, one vertical joint and a corner at the intersection of the joints. The system comprises two generally L-shaped sealing strips each with a pair of legs extending lengthwise parallel to one of the joints and each stopping a predetermined distance short of the corner. A corner piece has faces adjacent the horizontal surface and each of the walls, the faces being shorter than the predetermined distance. Two generally L-shaped flanges extend lengthwise beyond the ends of the faces, each of the flanges overlapping with the one of the L-shaped sealing strips. The overlap accommodates some variation from ideal in the length of the sealing strips. An end cap covers an end of a sealing strip remote from the corner. The cap comprises a generally L-shaped flange contoured to overlap an outside portion of one of the strips adjacent the end of the strip. A generally L-shaped end face extends from the L-shaped flange of the cap with one edge abutting one of the walls and one edge abutting the horizontal surface. A pair of fingers extends longitudinally along an inside surface of said one of the strips, with the fingers extending one from each edge of the end face.

24 Claims, 10 Drawing Figures

SEALING SYSTEM

FIELD OF THE INVENTION

The present invention relates to a system for sealing the joint between a pair of mutually perpendicular walls and a surface such as the top of a bathtub, counter top or sink.

BACKGROUND OF THE INVENTION

The joint between the top of a bathtub and the adjacent walls is one of the most pernicious and difficult joints to seal, especially where a shower is installed. The constant exposure to water means that the joint must be absolutely watertight. If water does enter the joint, the lack of air circulation makes it almost inevitable that the underlying walls and adjacent structure will not dry out before the next shower. Structural damage nearly always results, either immediately or over a period of time. The same considerations apply to the joint between a kitchen counter top or sink and the surrounding backsplash. In both situations it is highly desirable to seal the joint completely.

Numerous solutions have been tried to protect the wall from the invasion of water at a joint between the wall and the top of a tub or a counter top or sink. Ceramic tiles with a quarter circle cross section grouted in place have been used. Adhesive products intended to bond yet remain flexible have been tried, and various plastic strips shaped to fit in the juncture of tub or sink and wall or backsplash, respectively, have been tried. Many of these products are difficult for the home owner to install or apply, and others are not entirely effective. That new products continue to appear is ample testimony that the problem has not been completely solved.

SUMMARY OF THE INVENTION

The present invention provides a sealing system for sealing the junction between a horizontal surface such as the top of a tub, counter top or sink and two adjacent walls such as the walls of a shower or backsplash behind a sink. These walls are usually nearly perpendicular to each other and to the top plane of the tub or sink. The system comprises at least two plastic generally L-shaped sealing strips each with a pair of legs parallel to the joint defined by one of the walls and the surface of the tub, counter top or sink. One leg of each strip abuts a wall surface while the other abuts the top of the tub, counter top or sink. The strips are positioned along the joints to be sealed and stop a predetermined distance, usually about one inch, from the corner where the two walls meet. A corner piece covers the remaining exposed portions of the joints. The corner piece includes flanges which overlap with the legs of the sealing strips. An adhesive seals all the joints between the corner piece and the strips and in addition seals the corner piece to the walls.

The system also includes end caps for sealing the exposed ends of the sealing strips. Each end cap includes a generally L-shaped flange which overlaps the sealing strip, and an end face perpendicular to the axis of the strip and extending from the L-shaped flange to the wall and top tub surface. A pair of fingers extend lengthwise behind the strip to hold the end cap in place. One finger presses against the back of each leg of the strip.

The invention, then, comprises the features hereinafter fully described and particularly pointed out in the claims, the following description and annexed drawings setting forth in detail a certain illustrative embodiment of the invention, this being indicative, however, of but one of the various ways in which the principles of the invention may be embodied.

DESCRIPTION OF PREFERRED EMBODIMENT

Figure 1:
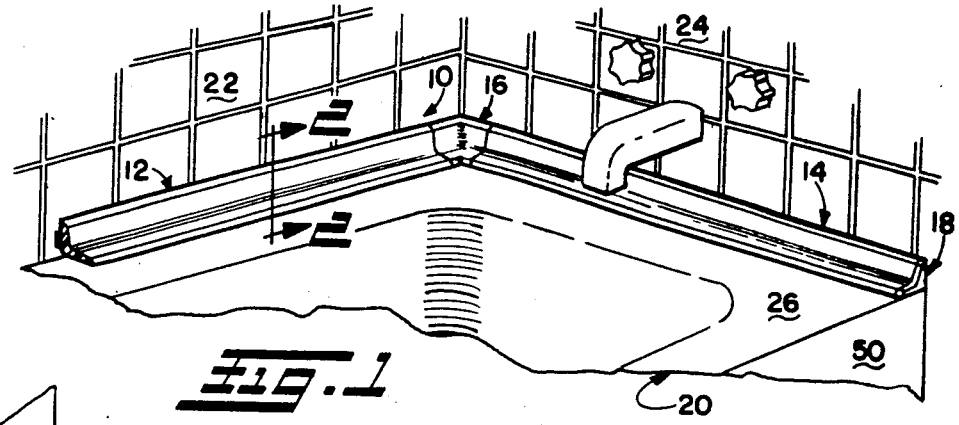
FIG. 1 is a perspective illustration of the sealing system of the present invention including a pair of sealing strips, a corner piece and an end cap installed to seal the joint between the top surface of a bathtub and adjacent walls.

The sealing system 10 illustrated in FIG. 1 includes sealing strips 12 and 14, a corner piece 16, and an end cap 18. The tub 20 is shown located in a corner defined by a back wall 22 and an end wall 24 at the foot end of the tub. Typically there may be an additional wall (not shown) parallel to end wall 24 at the head end of the tub 20.

The sealing system 10 seals the joints between the back wall 22, end wall 24 and the top surface 26 of the tub 20. While the present application specifically discloses the sealing system 10 in the context of sealing the joints between the top surface of a tub and the adjacent walls, it should be understood that the present invention is equally applicable to the joints between the top surfaces of sinks or counters and backsplashes.

Figure 2:
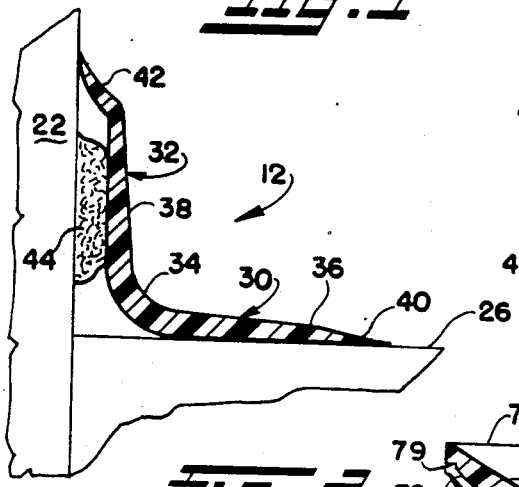
FIG. 2 is a an enlarged sectional view through one of the sealing strips, looking in the direction of arrows 2—2 of FIG. 1.

The sealing system 10 of the present invention is extremely simple to apply and provides an effective watertight seal. Sealing strips 12 and 14 are generally similar, and FIG. 2 illustrates the sealing strip 12. The sealing strip 12 includes two legs 30 and 32 extending at substantially right angles to one another such that one of the legs 30 is adapted to be disposed adjacent the top surface 26 of the tub 20 and the other leg adjacent the back wall 22. The legs 30 and 32 are connected by a curved wall 34 and include generally planar main body portions 36 and 38 that form approximately a 94° angle with respect to each other.

Each leg 30 and 32 terminates in a flexible sealing lip 40, 42. The flexible sealing lips 40 and 42 extend at an angle for example of approximately 35° to their respective main body portions 36 and 38 and toward the top surface 26 of the tub 20 and back wall 22, respectively. The sealing strip 12 may be extruded from two different materials. This permits the main body portions 36 and 38 and the curved corner wall 34 connecting them to be formed of a relatively hard, nearly rigid, inexpensive plastic material and the flexible sealing lips 40 and 42 to be formed of a softer, more flexible material, which is generally more expensive.

Figure 3:
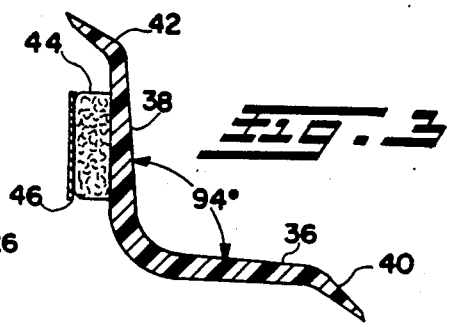
FIG. 3 is a view generally similar to FIG. 2 but showing a sealing strip constructed in accordance with the present invention prior to installation.
Figure 4:
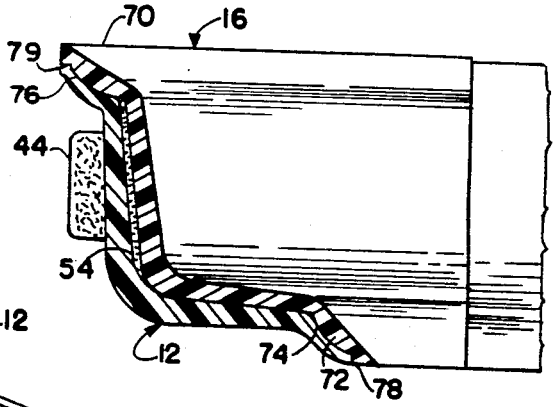
FIG. 4 is an enlarged partial section showing a corner piece constructed in accordance with the present invention in overlapping engagement with a sealing strip such as that of FIGS. 2 and 3.

To secure the sealing strips in place, an adhesive 44 is applied to the back of the vertical leg 32. The adhesive should be a flexible, waterproof adhesive such as a butyl adhesive and is applied in a lengthwise strip. As supplied to a customer, the butyl adhesive 44 may be covered with a protective strip of paper 46 (FIG. 3). Prior to installation the paper strip 46 is removed, and then the sealing strips 12 and 14 are pressed against the wall with the adhesive against the vertical back wall 22 or end wall 24 (FIG. 1). There is no need for any adhesive between the sealing strips 12 and 14 and the top 26 of the tub 20. When pressed in place the adhesive 44 holds the sealing strips 12 and 14 against their respective walls with the flexible sealing lip 42 along the top edge resiliently pressed against the wall surface and the flexible sealing lip 40 pressed against the bathtub top 26 to provide suitable barriers against water entry. Because the butyl adhesive 44 is waterproof, it forms a second barrier to prevent passage of water behind the sealing strip into the joint between the wall 22 and bathtub top 26.

To install the sealing system 10, first the distance from the back wall 22 to the front face 50 of the tub 20 is measured and the sealing strip 14 is cut about one inch shorter than this distance. Because of the design of the corner piece 16 (to be discussed below) the exact length of the sealing strip 14 is not critical and may vary plus or minus approximately 3/16" from the ideal. In a preferred embodiment the sealing strip 14 is cut one inch shorter than the distance from the back wall 22 to the front face 50 of the tub. In the case of the sealing strip 12, the distance between end wall 24 and the opposite end wall (not shown) is measured, and the sealing strip 12 is cut approximately two inches shorter than that distance.

The next step in the installation process is to connect the corner piece 16 (FIG. 5) to one of the sealing strips, for example, the sealing strip 12 which will run along the back wall 22. This is done by applying adhesive to the corner piece 16 along the back side where it contacts the sealing strip 12 adjacent one end, as shown at 54 (FIG. 6). Adhesive is also applied along the back side adjacent the other end 55, and around the back of the corner piece 16 as shown at 56 to form a continuation of the adhesive strip 44. For this purpose adhesive may be removed from discarded portions of sealing strip material and applied to the corner piece 16.

The corner piece 16 is shaped to mate with each of the legs 30 and 32 of the two sealing strips 12 and 14, to fill the gap between the ends of the sealing strips and the corner, and to seal the corner against the invasion of water. To this end the corner piece 16 includes three planar elements 60, 62, and 64 (FIG. 6) which are approximately mutually perpendicular and connected by smoothly curved walls. Planar element 60 has a face parallel to the horizontal tub surface and the other surfaces 62 and 64 are parallel upon installation to the back wall 22 and end wall 24, respectively.

At the opposite ends of the planar elements 60, 62, and 64 are end flanges 66 and 68 which form extensions of the planar elements. The thickness of the end flanges on the back side of the corner piece is less than the thickness of the planar elements by approximately the thickness of the respective legs 30 and 32 of the sealing strips 12 and 14 for receipt of the ends of the sealing strips behind the flanges. Specifically, the flange 66 forms an extension of planar elements 60 and 62 and extends about $\frac{3}{8}$ inch in the direction of the lengthwise axis of the sealing strip 12, whereas the flange 68 forms an extension of the elements 60 and 64 and similarly is about $\frac{3}{8}$ inch long but in the direction of the axis of the sealing strip 14. The flanges 66 and 68 each overlap an end portion of a respective sealing strip. Because of the overlap, some variation in the length of the sealing strips 12 and 14 is possible, and this facilitates installation.

Each end of the flanges 66 and 68 has a flared edge 70 and 72 (FIGS. 5-7) which parallels the flexible lips 40 and 42 of the sealing strips. The flared edges 70 and 72 have convex under surfaces 74 and 76 which press the flexible lips of the sealing strip to assure a tight seal therebetween. In addition, a ridge 78 and 79 extends along the length of each flared edge to engage the edge of the flared lips 40 and 42, respectively. When installed, the corner piece forms a continuation of the contour of the sealing strips, although slightly raised from the exposed faces of the sealing strip.

Figure 5:
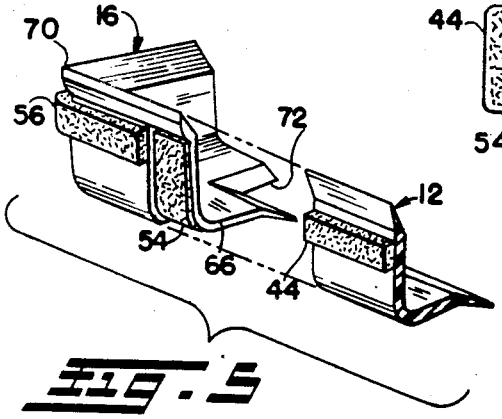
FIG. 5 is an exploded perspective view of the corner piece of FIG. 4 and a portion of a sealing strip.
Figure 6:
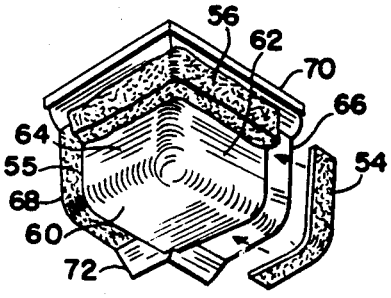
FIG. 6 is another view of the corner piece of FIG. 5.
Figure 7:
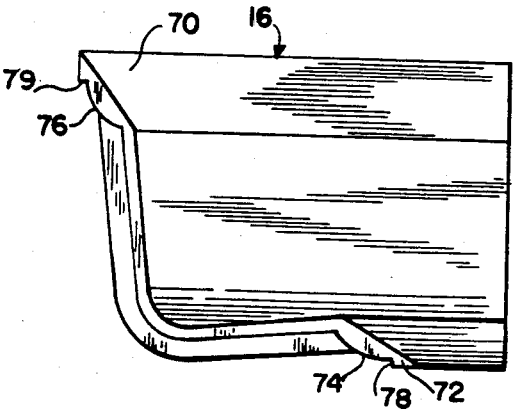
FIG. 7 is a side view of the corner piece of FIG. 6.

To assure a watertight seal between the corner piece 16 and sealing strips 12 and 14, adhesive strips 54, 55, and 56 are applied along the back edges of the flanges as shown in FIGS. 5 and 6 just below the flared edge 70 and along the length of the flanges 66 and 68. Once the corner piece 16 has been prepared with adhesive strips 54, 55, and 56 and stuck to one end of the sealing strip 12 and, if required, another corner piece prepared with adhesive and stuck to the opposite end of the sealing strip 12, the sealing strip 12 together with the corner pieces are pressed into the joint between the back wall 22 and the top 26 of the tub (FIG. 2). Thereafter, the sealing strip 14 is put in place with the lefthand edge of the sealing strip (as viewed in FIG. 1) slid behind the flange 68 of the corner piece 16. To facilitate installation, the pieces may be first put in place loosely, and once all are in place, firm pressure may be applied to positively locate the sealing strips 12 and 14 and the corner piece 16.

Figure 8:
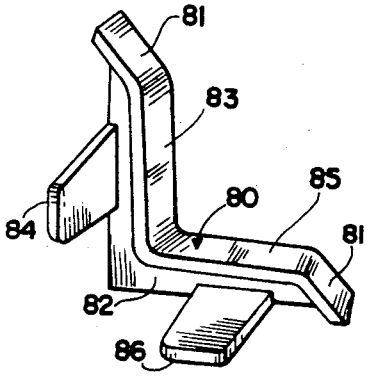
FIG. 8 is a perspective illustration of an end cap constructed in accordance with the present invention.

Once the sealing strips 12 and 14 and corner pieces 16 are in place, one or more end caps 18 may be installed at the ends of the sealing strips remote from the corner pieces. The end caps may be inserted on either end of the strips simply by rotating the end caps 180°. Each end cap 18 includes a generally L-shaped flange 80 (FIG. 8) with flared edges 81 which conform to the outside contour of the sealing strips 12 and 14. An end face 82 extends from the flange 80 toward the adjacent wall 22 or 24 and top surface 26 of the tub 20.

Figure 10:
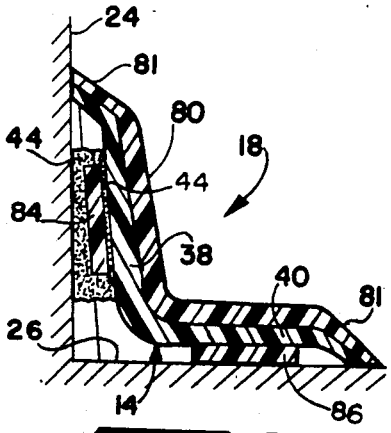
FIG. 10 is a sectional view showing an end cap installed on a sealing strip.
Figure 9:
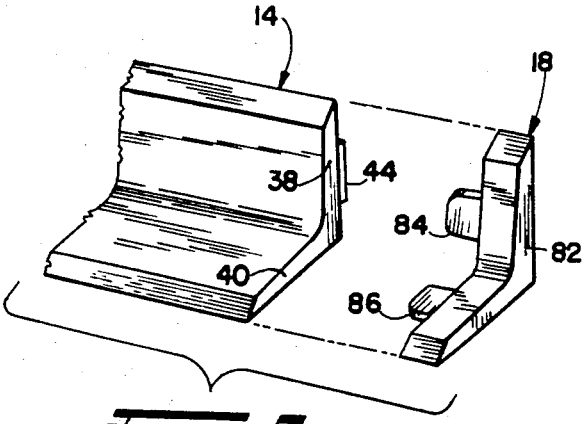
FIG. 9 is an exploded illustration showing installation of the end cap of FIG. 8 on a sealing strip constructed in accordance with the present invention.

A pair of flat fingers 84 and 86 extend parallel to the respective legs 83 and 85 of the flange 80 for insertion behind the legs 38 and 40 (FIGS. 9 and 10) of the respective sealing strips. The fingers 84 and 86 hold the flange 80 of the end caps 18 tight against the sealing strips. The fingers 84 and 86 desirably extend about twice the axial length of the flange 80 in the direction of the sealing strip. This helps to stabilize the caps 18 to keep them from being inadvertently knocked off. Upon installation (as shown in FIG. 10) the finger 84 extends into the adhesive 44 which bonds the leg 38 of the sealing strips to the wall.

Thus it is clear that the present invention provides a sealing system 10 (FIG. 1) for sealing the junction between a horizontal surface such as the top 26 of a tub 20 or sink and two adjacent walls such as the walls 22 and 24 of a shower or backsplash behind a sink. The system comprises at least two generally L-shaped sealing strips 12 and 14 each with a pair of legs 30 and 32 (FIG. 2) parallel to the joint defined by one of the walls, e.g. wall 22, and the top surface 26 of the tub 20. The strips 12 and 14 are positioned along the joints to be sealed and stop a predetermined distance, usually about one inch, from the corner. A corner piece 16 covers the remaining exposed portions of the joints, and includes flanges 66 and 68 which overlap with the legs of the sealing strips 12 and 14. An adhesive seals all the joints between the corner piece 16 and the strips and in addition seals the corner piece to the walls 22 and 24.

The system also includes end caps 18 for sealing the exposed ends of the sealing strips. The end caps 18 include a generally L-shaped flange 80 (FIG. 8) which overlaps the sealing strips and an end face 82 perpendicular to the axis of the strips and extending from the L-shaped flange to the wall and top tub surface 26. A pair of fingers 84 and 86 extend lengthwise behind the strips to hold the end caps 18 in place. One finger 84, 86 presses against the back of each leg 30, 32 of the strip. By rotating the end caps 180°, the end caps can be placed on either end of the sealing strips.

Although the invention has been shown and described with respect to a certain preferred embodiment, it is obvious that equivalent alterations and modifications will occur to others skilled in the art upon the reading and understanding of the specification. The present invention includes all such equivalent alterations and modifictions and is limited only by the scope of the claims.

I claim:

1. A sealing system for sealing the junction between a horizontal surface such as the top surface of a bathtub, counter top or sink and two adjacent vertical surfaces, the vertical surfaces and horizontal surface being substantially mutually perpendicular and defining two longitudinal joints, one vertical joint and a corner at the intersection of the joints, said system comprising two generally L-shaped sealing strips each with a pair of legs extending lengthwise parallel to a respective one of the longitudinal joints and each stopping a predetermined distance short of the corner, and a one-piece corner piece having three generally planar, orthogonally intersecting walls of substantially uniform thickness respectively adjacent the horizontal and vertical surfaces, said walls being shorter than the predetermined distance, and two flanges extending longitudinally beyond the ends of said walls, said flanges having front sides forming a continuation of the front sides of said walls and having a thickness from the front sides of said flanges less than the thickness of said walls for receipt of said sealing strips behind said flanges, each of said flanges overlapping with the one of the L-shaped sealing strips.

2. The sealing system of claim 1 including an adhesive strip securing each sealing strip to the adjacent vertical surface, additional adhesive strips between two of said walls of said corner piece and the adjacent vertical surfaces for securing said corner piece to said vertical surfaces, and adhesive between said flanges of said corner piece and the respective one of said sealing strips, said adhesive being applied to a substantial portion of the length of said flanges.

3. The sealing system of claim 1 including an adhesive strip securing said corner piece to the vertical surfaces.

4. The sealing system of claim 1 wherein said legs of said sealing strips include generally planar main body portions which are approximately mutually perpendicular and a flexible peripheral lip extending along the length of an outer edge of each main body portion obliquely to the plane of the respective main body portion.

5. The system of claim 4 wherein said corner piece includes flared edges for overlapping and forming continuations of said peripheral lips.

6. A decorative sealing end cap for covering an end of a generally L-shaped sealing strip with a pair of legs extending lengthwise parallel to a joint between a generally horizontal surface such as a bathtub, counter top or sink and a generally vertical surface, the two legs of the sealing strip being approximately mutually perpendicular and each having an inside surface, one being adjacent the vertical surface and the other being adjacent the horizontal surface, and exposed outside surfaces, said end cap comprising a generally L-shaped flange means contoured to overlap a portion of the outside surface of the sealing strip adjacent the end of the strip, a generally L-shaped end face means extending from the flange means with one edge for abutting the vertical surface and another edge for abutting the horizontal surface, and a pair of finger means extending one from each said edge of the end face means for pressing against respective inside surfaces of the legs of the sealing strip, each finger means having an inside surface flush with the respective edge of said end face means.

7. The end cap of claim 6 wherein both said finger means extend axially from said end face means of said cap a greater distance than said flange means.

8. The end cap of claim 6 wherein both said finger means have flat major surfaces for contacting with the inside surfaces of the legs of the sealing strip.

9. The end cap of claim 8 in combination with said sealing strip, said sealing strip including a strip of adhesive on the inside surface of one leg of said sealing strip, and one of said finger means being positionable in line with the adhesive strip for contact by a portion of the adhesive strip when said end cap is assembled to said sealing strip.

10. The end cap of claim 6 in combination with said sealing strip, and wherein the legs of the sealing strip are joined by an arcuate section and each has a lip extending along its distal edge, the lips of said legs extending obliquely away from the respective inside surfaces thereof for contacting, respectively, the vertical surface and horizontal surface, and said finger means being generally rectangular in cross section and having a width less than the distance between said arcuate section and respective one of said lips.

11. The combination of claim 10 wherein each of said finger means has a thickness less than the distance each lip projects from the inside surface of the leg from which it extends.

12. The combination of claim 10 wherein said flange means includes flared edges approximately parallel with the lips of the sealing strip.

13. A one-piece corner piece for filling a gap between the ends of two sealing strips used to seal the junction between a horizontal surface and two adjacent vertical surfaces and a corner between such vertical and horizontal surfaces, said corner piece comprising three generally planar, orthogonally intersecting walls of substantially uniform thickness adapted to be positioned respectively adjacent and substantially parallel to such horizontal and vertical surfaces, and flanges extending lengthwise beyond the ends of said walls, said flanges having front sides forming a continuation of the front sides of said walls, said flanges having a thickness from the front sides of said flanges which is less than the thickness of said walls for receipt of the ends of such sealing strips behind said flanges in overlapping relationship.

14. The corner piece of claim 13 further comprising adhesive strip means extending along the back sides of two of said walls for securing said corner piece to both such vertical surfaces, and additional adhesive strip means on the back sides of said flanges, said additional adhesive strip means being applied to a substantial portion of the length of said flanges for securing the ends of such sealing strips to said flanges.

15. The corner piece of claim 13 further comprising flared edges extending along the upper and lower edges of said flanges at an angle toward the back sides of said flanges.

16. The corner piece of claim 15 wherein said flared edges have convex under surfaces which are adapted to press against peripheral lips on such sealing strips to assure a tight seal therebetween.

17. The corner piece of claim 16 further comprising ridge means extending along the length of said under surfaces of said flared edges which are adapted to engage the edges of such peripheral lips at the ends of such sealing strips.

18. The end cap of claim 6 wherein each said finger means has a major planar surface flush with the respective edge of said end face means.

19. A sealing system for sealing the junction between a horizontal surface such as the top surface of a bathtub, counter top or sink and two adjacent vertical surfaces, the vertical surfaces and horizontal surface being substantially mutually perpendicular and defining two longitudinal joints, one vertical joint and a corner at the intersection of the joints, said system comprising two generally L-shaped sealing strips each with a pair of legs extending lengthwise parallel to a respective one of the longitudinal joints and each stopping a predetermined distance short of the corner, a corner piece having walls respectively adjacent the horizontal and vertical surfaces, said walls being shorter than the predetermined distance, and two flanges extending longitudinally beyond the ends of said walls and having a thickness from the front side less than the thickness of said walls for receipt of said sealing strips behind said flanges, each of said flanges overlapping with the one of the L-shaped sealing strips, and an end cap covering an end of a sealing strip remote from the corner, said end cap comprising a generally L-shaped flange overlapping an outside portion of one of the strips adjacent the end of the strip, a generally L-shaped end face extending from the L-shaped flange of the end cap with one edge abutting one of the vertical surfaces and another edge abutting the horizontal surface, and a pair of finger means for extending longitudinally along an inside surface of said one of said strips, said finger means extending one from each edge of said end face.

20. The sealing system of claim 19 wherein said fingers extend axially from said end face of said end cap a greater distance than said flange.

21. The sealing system of claim 19 wherein said fingers have flat major surfaces disposed in contact with the inside surfaces of the legs of the sealing strip.

22. The sealing system of claim 21 wherein the sealing strip includes a strip of adhesive between such one of the vertical surfaces and the inside surface of the strip leg adjacent such one of the vertical surfaces, one of said fingers being in line with the adhesive strip and being in contact with a portion of the adhesive strip for securing said end cap to said sealing strip.

23. A sealing system for sealing the junction between a horizontal surface such as the top surface of a bathtub, counter top or sink and two adjacent vertical surfaces, the vertical surfaces and horizontal surface being substantially mutually perpendicular and defining two longitudinal joints, one vertical joint and a corner at the intersection of the joints, said system comprising two generally L-shaped sealing strips each with a pair of legs extending lengthwise parallel to a respective one of the longitudinal joints and each stopping a predetermined distance short of the corner, and a corner piece having generally planar, orthogonally intersecting walls of substantially uniform thickness respectively adjacent the horizontal and vertical surfaces, said walls being shorter than the predetermined distance, and two flanges extending longitudinally beyond the ends of said walls and having a thickness from the front side less than the thickness of said walls for receipt of said sealing strips behind said flanges, each of said flanges overlapping with the one of the L-shaped sealing strips, said legs of said sealing strips including generally planar main body portions which are approximately mutually perpendicular and a flexible peripheral lip extending along the length of an outer edge of each main body portion obliquely to the plane of the respective main body portion, said corner piece including flared edges for overlapping and forming continuations of said peripheral lips, and said flared edges having convex under surfaces which press against said peripheral lips to assure a tight seal therebetween.

24. The sealing system of claim 23 further comprising ridge means extending along the length of said under surfaces of said flared edges for engagement by the edges of said peripheral lips at the ends of said sealing strips.

* * * * *